US008469726B2

(12) United States Patent
Perales Fayos

(10) Patent No.: US 8,469,726 B2
(45) Date of Patent: Jun. 25, 2013

(54) CONNECTORS WITH BRUSHES AND PINS WHICH SLIDE ALONG ELECTRICAL GUIDES FOR HOME, BUSINESS OR INDUSTRIAL INSTALLATIONS

(75) Inventor: Angel Perales Fayos, Fuente de la Higuera-Valencia (ES)

(73) Assignee: Sistemas Metalper, S.L., La Font de la Figuera (Valencia) (ES)

( * ) Notice: Subject to any disclaimer, the term of this patent is extended or adjusted under 35 U.S.C. 154(b) by 146 days.

(21) Appl. No.: 12/992,899

(22) PCT Filed: Apr. 30, 2009

(86) PCT No.: PCT/ES2009/000232
§ 371 (c)(1),
(2), (4) Date: Nov. 16, 2010

(87) PCT Pub. No.: WO2009/147256
PCT Pub. Date: Dec. 10, 2009

(65) Prior Publication Data

US 2011/0070754 A1 Mar. 24, 2011

(30) Foreign Application Priority Data

Jun. 6, 2008 (ES) ..... 200801215 U

(51) Int. Cl.
*H01R 25/00* (2006.01)

(52) U.S. Cl.
USPC ..... 439/110; 439/119

(58) Field of Classification Search
USPC ..... 439/110, 119, 120
See application file for complete search history.

(56) References Cited

U.S. PATENT DOCUMENTS

| | | | | |
|---|---|---|---|---|
| 4,812,134 | A * | 3/1989 | Miller et al. | 439/110 |
| 6,309,229 | B1 * | 10/2001 | Sinclair | 439/110 |
| 7,374,444 | B1 | 5/2008 | Bennett | |
| 7,438,566 | B2 * | 10/2008 | Chen | 439/110 |
| 2004/0005798 | A1 * | 1/2004 | Lin | 439/110 |
| 2011/0065294 | A1 * | 3/2011 | Geiser et al. | 439/110 |

FOREIGN PATENT DOCUMENTS

| | | |
|---|---|---|
| EP | 0 689 267 | 12/1995 |
| GB | 2 067 363 | 7/1981 |
| GB | 2 408 854 | 6/2005 |
| WO | 2008/046836 | 4/2008 |

OTHER PUBLICATIONS

International Search Report issued Sep. 24, 2009 in International (PCT) Application No. PCT/ES2009/000232.

* cited by examiner

*Primary Examiner* — Hien Vu
(74) *Attorney, Agent, or Firm* — Wenderoth, Lind & Ponack, L.L.P.

(57) ABSTRACT

Female connectors which slide along some guides in home, business or industrial installations and allow electricity to be transported from one point to another without the need for extension cables. The connector slides along the guide which includes, in the interior thereof, some electrical brushes connected to some brass connectors which transport the electricity towards the poles of a male connector from some tracks which, in turn, are connected to the mains or the general electrical installation. Alternatively, the connector slides along some guides having electrical pins which are connected to the general electrical installation via the tracks.

5 Claims, 2 Drawing Sheets

CONNECTORS WITH BRUSHES AND PINS WHICH SLIDE ALONG ELECTRICAL GUIDES FOR HOME, BUSINESS OR INDUSTRIAL INSTALLATIONS

FIELD OF THE INVENTION

The application scope of the invention would be that addressed by the entire industry devoted to manufacture or market connectors and electrical material or components, also including, in the same scope, the sector intended for electrical installations and generally, electricity, as well as market sectors that manufacture or market plastic elements along with all their derivatives, especially considering the branch of profiling, molding, casting and extrusion of plastic or PVC guides and pieces.

BACKGROUND OF THE INVENTION

On the part of the applicant, there is currently unknown the existence of an invention having the described characteristics, wherein its use is completely new.

The so-called sliding bridges with crane or pulley are currently used somehow with some similarity in industrial or mechanical workshops, wherein the connection and electricity constantly flow directing said bridges using a button panel, with ceiling to floor cables and always moving in a horizontal direction into a single plane, being shown as a constant connection to a movable bridge and not as an alternative connector to which different apparatuses or machines can be connected. It is known to use in some workshops, an electrified metal bar always in proximity to an area of difficult access due to its dangerousness, usually located at ceilings and high places, with a connector that can be positioned after the electricity has been disconnected from the bar or general mains.

It is unknown so far, a connector which slides along electrical guides allowing, in a practical and economical manner, installing different and various connectors with guides in order to have electrical power at any point of the environment, through walls or ceilings, and as middle-height borders in bathrooms, kitchens and other home rooms, or likewise in business, hair-dressing salons, beauty centers, gyms, etc. for example. Offering the user a much more comfortable and versatile installation with the combination of sliding connectors and guide tracks connected to each other in order to distribute the guides driven them where is most convenient. Through the present invention, connectors and electrical guides are designed with the aim of effectively engaging each other and consequently ensuring the safety, the transportation of an unspecified number of connectors along one or more electrical guides for driving the current and feed it to different moveable or fixed devices comprising extensions or not.

SUMMARY OF THE INVENTION

The present invention relates, in this case, to the novel design of connectors and electrical guides intended for mainly improving the effectiveness and simplicity or convenience when electricity needs to be transported to another point in the home, business, or companies, and workshops. Electrical transport is enabled by sliding connectors along fixed guides on the walls and even inserting them into the construction to be leveled, not only allowing electrical power to be transported towards the opposite side of the guide, but also using that sliding for example in apparatuses or household appliances to provide their mobility without having to disconnect the connectors from the mains, achieving through the application of this invention that electricity can be used in the desired location and as needed without requiring extension cables.

Connectors with brushes and pins which slide along electrical guides for home, business or industrial installations to which the description relates correspond in this case to the creation and design of certain connectors initially configured from a single piece protruding from the interior of the guide profile, manufactured through molds for casting plastic and PVC, with a design on the rear part of the sliding connector so that it is fitted into the hollowed space of the profile for suitable sliding along the interior thereof.

These connectors overall include both the female connection of each of the poles provided in all conventional male connector and the ground connection, by designing hollow housings into which several copper or brass inner connectors are fitted, so that the projecting poles that all officially approved connector necessarily carries in any connection and for any kind of domestic apparatuses or machines penetrate therein.

Electrical power transportation between the cable with connector of an apparatus and the female connector which slides along the guide is solved by directly contacting the mentioned poles of a male connector with the smooth surface of a kind of metal, copper or brass key, one key for each current phase and other for the ground connection, inner connectors previously described being placed in an anchored manner above them as receivers for the connector poles, further making contact with each of the keys.

A cable with connector or triple female connector always houses inside the solid piece for a better use of the space, the part of this piece inside of which the connectors, keys and poles of a male connector are housed, is fitted into the guide thereby facilitating the sliding of the connector, and the other connector part is that protruding the exact space from the electrical guide in order to allow the connector head to be housed.

Prior to the molding of the piece, some copper cables or solid metal rod connecting to the keys and via the opposite end to the other keys with identical characteristics are inserted, forming a structure inside the connector and serving to continuously provide a current continuity to each electrical phase always separately, also these latter keys act as base and surface contact with electrical brushes composite of carbon, metals and graphite, and are arranged as a kind of tablets or lozenges both on the top of the solid piece fitting inside the guide and on its bottom, corresponding to each of the electrical phases employed.

On the rear face of the piece and sliding connector connected to thereof, a metal spring that exerts pressure when a certain clearance is between the rear area of the connector and the inner wall of the PVC guide or profile is anchored, which has a longitudinal metallic or brass plate embedded along the guide, as a track, which in this case is directly contacted with the ground connection of the electrical installation.

This is also achieved in the case of the two described brushes, since these in turn contact with their corresponding track or solid plate preferably made of brass, which transports the current received, by connecting the guides with the tracks to the mains, preferably using solid tracks, although having the option of using tracks made with twisted cable.

Brushes including connecting cables can also be used instead of keys, thus going the connection directly to the copper or brass connectors without using any keys nor copper cables or solid rod inserted into the molded piece.

Another possibility of mounting is also given for the entire ground connection, by using an internally threaded hollow or solid rod rather than a key contacting the officially approved strip existing in female connectors, in order to screw this officially approved strip to one end of the threaded rod, by centrally drilling and going through the connector, and the other end of the rod protruding from the rear part of the sliding piece, such that, the metallic spring is joined to the rod by another screw, forming the strip, the rod and the spring a single piece.

The guides are configured from a PVC longitudinal profile taking a rectangular almost completely closed and hollow in the interior shape, leaving an open section on one of the sides and towards a middle-height of the profile, creating a sort of slot, which occupies the entire guide length with the aim of enabling the connector forming a piece along with the sliding part to be inserted and slid along the guides continuously.

At each inner end of this "C"-shaped guide, generated by the open section, the recesses needed by said guide for inserting the mentioned electrical brass tracks are made, by setting a minimal clearance for their proper longitudinal installation and in order to further leave a space if appropriate occupied by adhesive material, and by fixing the tracks to the guide walls, so that these can be subsequently cut to size and according to the location or user needs, without involving the mobility of the tracks and the consequent failure or mismatch in the connection of successive guide sections.

The link or connection of the guides to the sliding connectors, in the home, business or industrial electrical installation is carried out through the design of some plastic or PVC molded pieces tightly fitted as plugs into the rectangular space inside the guide ends fully occupying the profile section, with several through holes and threaded caps wherein a threaded stem or rod is screwed, said rod making contact with one of the tracks, when going through the thickness of the plug, by for example joining the cable corresponding to a wiring phase in the home by the opposite end of this threaded rod and via a small through hole.

The connecting means is repeated for other phases and for the ground connection cable, this cable connection being concealed by side lids for joining the guides by using screws.

There is offered the possibility of fixing the guides to the wall by fitting into an anchoring profile that houses the guide immobilizing it, and the corresponding raglet being previously performed in the construction or reserving a space for it in new construction and the anchoring profile joining to the wall by mortar or glue, being leveled within it, and guides are subsequently fitted by pressure inside the anchoring profile or alternatively, with proper clamps, fixed by pressure on walls or ceilings without anchoring profiles, by using screws to anchor the clamps in the walls and ceilings always drilling small through holes to allow circulation and vented current of the air towards all the guides of this invention designed for such purpose, wherewith helps to keep the interior of the guide without possible moisture, further serving as evacuation areas.

This entire configuration is adapted, without varying the described elements, to the English and American electrical system, the same sliding connector being designed with cavities required for all these installations.

On the other hand, the sliding connectors with pins are an alternative manufacturing mean to reduce electrical guides, and these are effectively valid by being connectors with similar characteristics to those described but separated into two pieces, the sliding one along the interior of the guides and the disconnectable one when separating it from the latter, due to the versatility that offers or could offer in certain and varied environments, being part of the same invention since it has the same operation as that used in connectors with brushes, these being configured by the sliding piece fitted into the guide that will also have a "C" shape because of the longitudinal slot, the sliding piece minimally exceeding the guide longitudinal slot, and being manufactured in the same way that the sliding connectors with brushes through molds for casting PVC. Three housing slots or three holes being enabled are provided, although as the aim is to reduce the dimensions of the guide to the maximum and from there that the connector can be detached from the sliding piece, it will be preferable to use equidistantly arranged slots, thus significantly reducing the guide longitudinal slot.

Such slots are located in the front face of the piece going through it from side to side, leaving then a space for housing three connectors with pins, one for each electrical phase and in the centre for the ground connection, being screwed to the rear part of the piece, forming a 90° angle when are configured, some vertical pins being joined to screws as squares at different heights in each of them, whereby these will have a through hole in the lower end and will be perfectly joined to the vertical wall of the three mentioned connectors, to which other three pins that in addition of being squares could be straight are connected through the front face of the sliding piece, thus enabling the connection of the pins by the opposite end to conventional female connectors of two poles with ground connection, since the separation of the pins matches that of the connector, and the pins will also be drilled and tightly screwed to the connectors of the female connector detachable when is pulled out, thus making the pins simultaneously protrude, whereby the connection area is concealed by a hollow box with an outer shoulder that fits into the thickness of the protruding area in the sliding piece or element, carrying in the interior the connecting pins joined to the female connector and the connector itself to the described hollowed box.

Electrical guides for sliding connectors are embodied by pins through extruded PVC profiles, also in two pieces here assembled and resulting in a guide longitudinally open slot at one side along which the horizontal section of the "T" forming the sliding piece with slots and pins slides.

An extruded profile for the top of the guide is manufactured with a section having on the rear side a vertical section broken towards the interior at an approximate middle-height, and vertically down again up to level with the lower piece of the guide, a solid form with longitudinal housings designed for anchoring the electrical brass tracks separately and staggered located occupying the entire top of the described section in order to contact each pin with its corresponding height by sliding through thereof along the entire guide.

The piece of the bottom of the guide arranges several walls or vertical sections in the rear side, sections of which are assembled to the sidewall of the upper piece of the guide, and both sides of each piece making up the electrical guides being crisscrossly fitted, connected to the general mains in the same way as the guides and sliding connectors with brushes and installed in the wall or ceiling in the same way as the latter.

Both ones and others connectors include one or more warning lights indicating the presence or absence of current in the connectors, being anchored anywhere in the connector or sliding piece of a single or independent piece, and a casual or temporary switch or connecting or disconnecting plug of the guide with its corresponding energy saving can also be, further included in all the guides, mounted as initial sections directly connected to the general installation, thereby providing the user the entire possibility of choosing guides with or without plug for cases wherein continuous connection is required or in those in which its use results more or less convenient, as appropriate.

A series of connectors with brushes which slide along an upper guide and with more reduced female connector integrated therein is jointly and globally offered in the same manner and for the same reason of being selectable by the user, or on the other hand, guides smaller in size with conventional connectors adapted and detachable from the sliding piece, being in these cases a female connector with greater depth in the head and in the poles of a male connector, and the two poles do not penetrate inside the sliding piece and guide, as happens in connectors with brushes, resulting in guides more practical in some cases and others in another, as well as connectors of a single piece in some applications or detachable connectors in others, providing for the invention greater versatility and advantages in different uses, which may launch into the market as described in detail in the description or combining a connecting means through brushes for sliding pieces with pins and viceversa whenever results more beneficial for the user or for a manufacturing much more varied and adapted to optimization requirements officially approved in the field of electrical power or home, businesses and industrial general installations, by generally adding one more housing to the connectors and designing the connection for a third phase and the corresponding ground connection in the event of tree-phase connector.

Finally, and for installations wherein guides with the sliding piece separated from the detachable female connector are applied, which have both slots at the front and connecting holes, there is offered the possibility of connecting connectors that can be launched into the market with three poles and three connecting pins, previously supervising its proper adaptation, if required.

All aspects comprising the invention resulting in connectors which slide along electrical guides based on a sliding and consequent transportation of electricity valid for this series of connectors and guides, by being all of them integrated into a single novel concept with different application needs to be selectable by the user.

BRIEF DESCRIPTION OF THE DRAWINGS

To complement the description being made and with the object of contributing to a more detailed understanding of the characteristics offered by the novelty, a series of drawings is attached to this specification and as an integral part thereof, which will represent the following illustrative reasons.

DESCRIPTION OF AN EMBODIMENT OF THE INVENTION

Figure 1A:
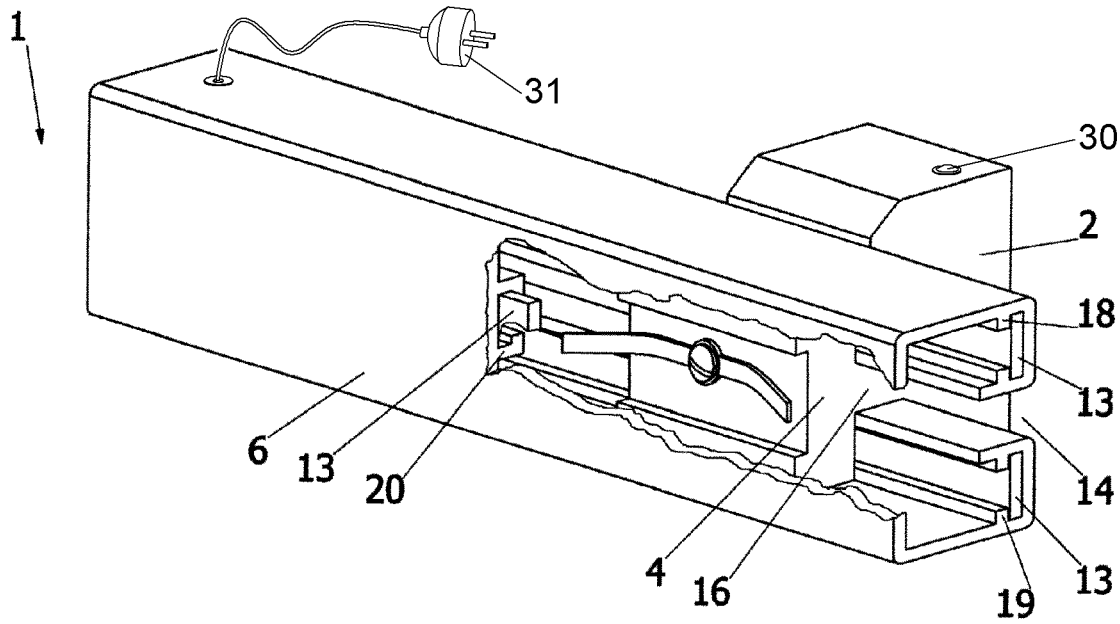
FIG. 1*a*: Provides information about the connector and sliding piece joined together, with brushes that slide, from a perspective view of the connector mounted in the guide, according to a first embodiment of the invention.
Figure 1B:
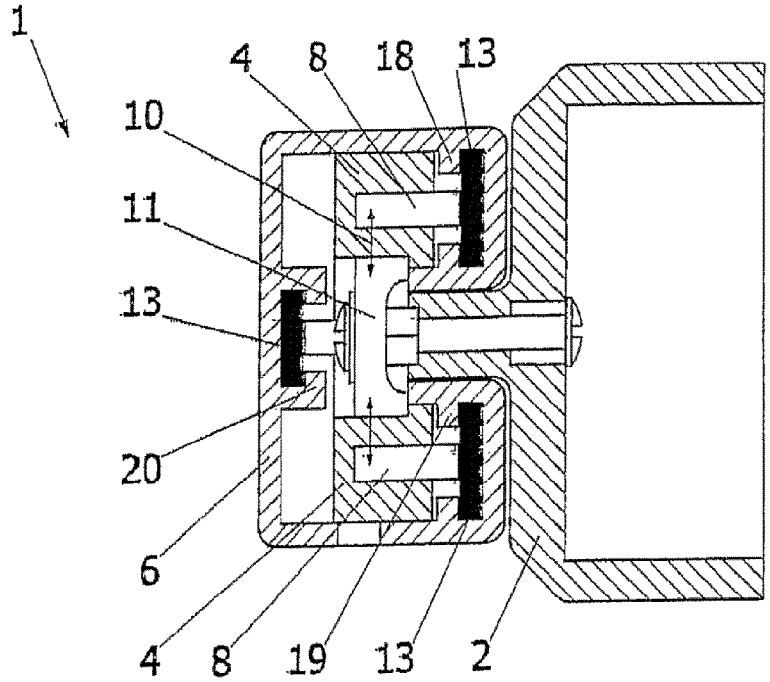
FIG. 1*b*: Represents the first embodiment of the invention in a cross section, again and more clearly appreciating the fitting of the different pieces into each other.
Figure 2A:
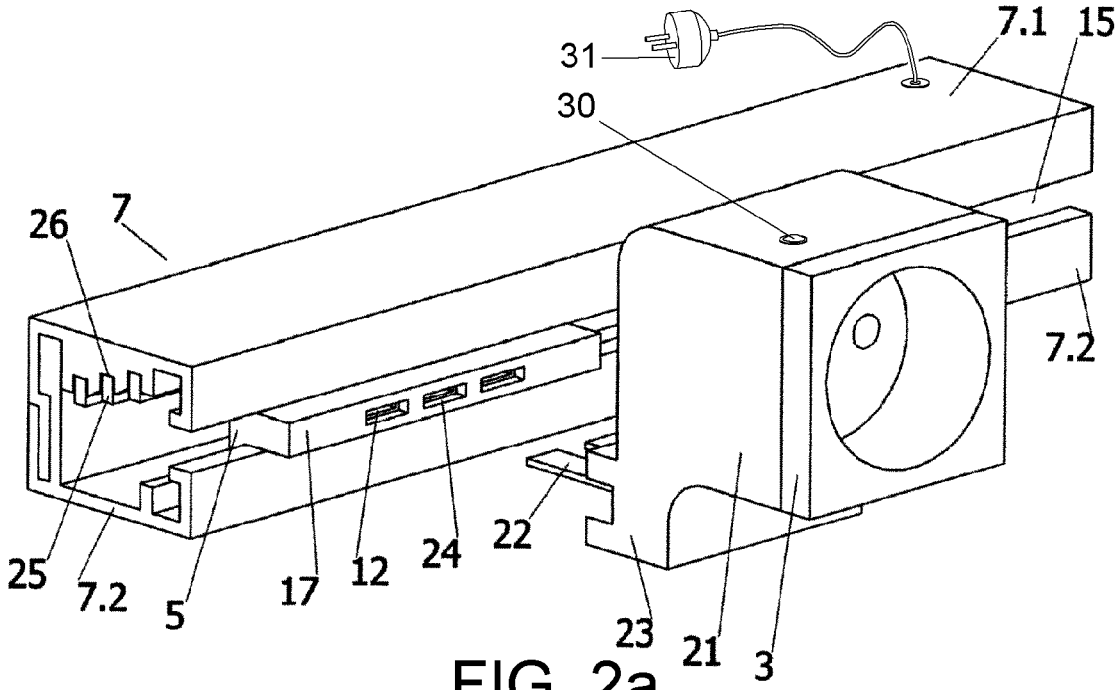
FIG. 2*a*: Provides information about the connector and sliding piece made into two pieces, with pins which slide and guides designed with several staggering at the top, from a perspective view of the connector mounted in the guide, according to a second embodiment of the invention.
Figure 2B:
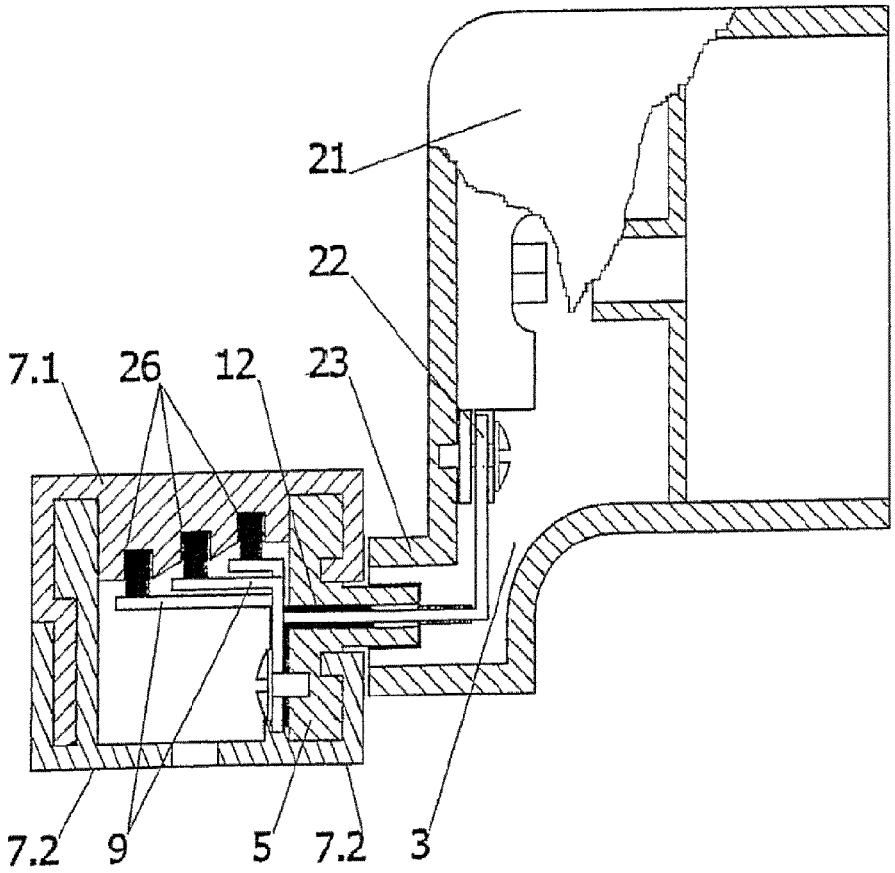
FIG. 2*b*: Represents the second embodiment of the invention in a cross section, again and more clearly appreciating the fitting of the different pieces into each other.

In view of the figures, these connectors with brushes and pins which slide along guides in home, business or industry installations (1), are configured from a sliding piece (4) joined to the female connector (2) by providing a space for housing the poles of a male connector and of the connector head itself respectively, making up the piece (4) and the connector (2).

Some electrical brushes (8) are installed at the top and bottom of the sliding piece (4) and in the interior of the guide (6) such that these are adhered to the piece (4), which have current cables (10) serving as a link between the brushes (8) and some brass inner connectors (11) contained inside the sliding piece (4), electricity fluidly passing through the brushes (8) to cables (10) and inner connectors (11) for transporting it towards the poles of a male connector, thus reaching the electrical power coming channeled into brass tracks (13), which are in turn connected to the mains or general electrical installation.

With reference to the assembly of the connectors (2) with sliding piece (4) attached to them, the necessary connectors (2) are then engage and inserted into the guide (6), being the guides (6) a single "C"-shaped piece profile with an open slot (14) along which the horizontal section (16) of the connector (2) connected to the sliding piece (4) slides, the aforementioned guides (6) besides having a top (18) and bottom (19) housing in the lower ends of the guide (6) for inserting the tracks (13), in proximity to the housing (20) made in the guide (6) at the inner wall of its rear part, at a middle-height, leading to the location of another track (13), in this case for the ground connection.

On the other hand, female connectors (3) adapted based on a conventional female connector officially approved with a design including a protective box (21), coupled with the connector (3), which conceals the connections of some pins (22) which are connected, by one of its ends, to the connector (3) are achieved. At the rear part of the box (21) and at a middle-height or by the bottom forming part of the same box (21), a hollowed notch (23) fitting into the horizontal section (17) of an independent sliding piece (5) carrying the female connector (3) is arranged, this piece (5) being slid inside some guides (7).

The independent sliding piece (5) is configured taking the form of a "T" arranged horizontally to the section (17), produced through molds for casting PVC and with equidistant slots (24) fully going through the piece (5) from the front to the rear part, wherein brass square connectors (12) are housed occupying the lower half of the slots (24), the ones on the sides for both electrical phases and the central one reserved for the ground connection.

The free end of each pin (22) is connected to the corresponding square connector (12), installed inside the slots (24), the vertical area of the connector (12) being joined by screws to the rear face of the piece (5), the screws passing before and going through the lower hole of some square pins (9), the vertical pins (9) thus properly coupled to connectors (12). are fitted and immobilized all the time, thus achieving a safe and adequate contact with the tracks (25) adhered inside the guides (7) along which the piece (5) perfectly slides.

The guide (7) is made into two pieces, the upper (7.1) and lower (7.2) flap, with PVC profiling, the assembly of the two pieces forming a "C" providing the longitudinally open slot (15) at a middle-height of the guide (7).

The flap (7.1) is subsequently created in a vertical section with a central slit, breaking at its top into a perpendicular section and housing therein three staggered housings (26) wherein tracks (25) are inserted.

The lower flap (7.2) with the flat base protruding, laterally and vertically, makes a double section with fitting slits being assembled in the vertical section of the upper flap (7.1) in the construction and mounting of guides (7).

The connectors of the present invention can include one or more warning lights (30) indicating the presence or absence of current in the connectors, being anchored anywhere in the connector or sliding piece (4, 5), and a connecting or disconnecting plug (31) of the guide (6, 7) can also be included in all the guides (6, 7), mounted as initial sections directly connected to the general installation, thereby providing the user the entire possibility of choosing guides with or without plug for cases wherein continuous connection is required or in those in which its use results more or less convenient, as appropriate.

All this series of connectors (2) and (3) with guides (6) and (7) provide overall a novel and useful invention that allows the possibility of transporting the current to all connectors (2) and (3) and sliding pieces (4) and (5) by circulating 1 through the open slots (14) and (15), the application or applications being installed in walls and ceilings in a practical and simple manner.

The elements used for this embodiment of connectors with brushes and pins which slide along guides for home, business or industrial installations (1) will be those described in the present invention, dimensions of any element constituting thereof can be varied or modified by virtue of the possible variations being launched into the market.

The terms in which the present specification is described will always be taken in a broad and not limitative manner.

The invention claimed is:

1. An electric connector assembly, comprising:

a connector; and a guide member for use in home, business or industrial installations, wherein said connector is designed from a female connector, said female connector being connected through a horizontal section to a sliding piece; wherein said sliding piece is inserted along inside the guide member; wherein said sliding piece includes brushes connected to the female connector; wherein said connector has standard terminals; wherein said brushes are connected to said female connector by a selection of: copper solid cables and keys, or electrical cables; wherein the brushes contact tracks housed in recesses of the guide member; wherein ground connection is connected through the contact of a metallic spring with track housed in a recess, which conducts an electrical ground current; and wherein said metallic spring is screwed to a first end of an inner threaded rod connected, by a second end thereof, to a standard strip of the female connector, and wherein the female connector is configured to slide along the guide member, the guide member having two parts or flaps, the female connector and the guided member being made of plastic or PVC material suitable to withstand temperatures and voltages of a transported electricity.

2. An electric connector assembly, comprising:

a connector; and a guide member for use in home, business or industrial installations, wherein said connector is designed from a female connector, said female connector being configured to be connected to a protective box; wherein the female connector is disconnectable from an independent sliding piece; said independent sliding piece centrally comprising equidistant slots in a horizontal section of said independent piece, thereby generating a series of aligned square connectors, and first pins extending from the protective box, and being anchored to each of said square connectors; said first pins being in constant contact with tracks located in staggered housings of an upper flap; said upper flap of the guide member by tight and crisscrossed assembly with a lower flap of the guide member; a hollowed notch fitted into the horizontal section of the independent sliding piece; said hollowed notch protruding from the rear part of the box at a position selected between a middle, top and bottom area; said hollowed notch being joined to the box forming a single piece; wherein the box is joined to the female connector; and wherein prior to the screwed assembly of the box, second pins are connected to connectors housed inside the female connector such that the second pins are immobilized and wherein the female connector is configured to slide along the guide member, the guide member having two parts or flaps, the female connector and the guide member being made of plastic or PVC material suitable to withstand temperatures and voltages of a transported electricity.

3. The electrical connector assembly according to claim 2, wherein the guide member reserves an open longitudinal space creating a slot; the female connector being configured to move forward or backward fitting the horizontal section into the slot, and being configured to be slid along thereof with the first pins contacting the tracks; wherein the female connector or the independent sliding piece include, at any location, warning lights indicating electrical presence and absence in the guide member; wherein plugs are capable of being installed at initial or final sections of the guide member; said plugs configured to temporarily connect and disconnect the guide member with respect to the home, business or industrial installation.

4. The electrical connector assembly according to claim 1, wherein the guide member is configured to be directly connected to an electrical network.

5. The electrical connector assembly according to claim 1, wherein the brushes are graphite or carbon.

* * * * *